US007367150B2

(12) United States Patent
Farchione et al.

(10) Patent No.: US 7,367,150 B2
(45) Date of Patent: May 6, 2008

(54) UNIVERSAL FIXED PIN TRIGGER BLOCK

(75) Inventors: Thomas Joseph Farchione, Victor, NY (US); Patrick Farchione, Jr., East Rochester, NY (US)

(73) Assignee: Regal Industrial Sales, Inc., Victor, NY (US)

( * ) Notice: Subject to any disclaimer, the term of this patent is extended or adjusted under 35 U.S.C. 154(b) by 179 days.

(21) Appl. No.: 11/299,217

(22) Filed: Dec. 9, 2005

(65) Prior Publication Data

US 2007/0017137 A1 Jan. 25, 2007

Related U.S. Application Data

(60) Provisional application No. 60/635,128, filed on Dec. 10, 2004.

(51) Int. Cl.
*F41A 17/54* (2006.01)

(52) U.S. Cl. ..... 42/70.07

(58) Field of Classification Search ..... 42/70.06, 42/70.07, 70.11

See application file for complete search history.

(56) References Cited

U.S. PATENT DOCUMENTS

| | | | | |
|---|---|---|---|---|
| 3,624,945 | A | 12/1971 | Foote | |
| 5,050,328 | A | 9/1991 | Insko | |
| 5,325,686 | A * | 7/1994 | Bentley | 70/58 |
| 5,437,119 | A | 8/1995 | Womack | |
| 5,487,234 | A | 1/1996 | Dragon | |
| 5,561,935 | A | 10/1996 | McCarthy et al. | |
| 5,704,151 | A | 1/1998 | West et al. | |
| 5,720,193 | A | 2/1998 | Dick | |
| 5,918,402 | A * | 7/1999 | Weinraub | 42/70.07 |
| 5,960,575 | A | 10/1999 | Chiovitt et al. | |
| 6,009,654 | A * | 1/2000 | Williams et al. | 42/70.11 |
| 6,260,299 | B1 * | 7/2001 | Jordan | 42/70.11 |
| 6,272,784 | B1 | 8/2001 | Ringers | |
| 6,276,086 | B1 * | 8/2001 | Keaton | 42/70.07 |
| 6,457,272 | B1 | 10/2002 | Weinraub | |
| 6,467,211 | B1 * | 10/2002 | Kielland | 42/70.07 |
| 6,487,803 | B1 * | 12/2002 | Yu | 42/70.07 |
| 6,718,678 | B2 | 4/2004 | Riebling et al. | |
| 6,722,071 | B1 * | 4/2004 | Lin | 42/70.07 |
| 7,216,449 | B2 * | 5/2007 | Riebling et al. | 42/70.07 |
| 2002/0069569 | A1 * | 6/2002 | Riebling et al. | 42/70.07 |
| 2004/0159034 | A1 * | 8/2004 | Riebling | 42/70.07 |
| 2004/0216349 | A1 * | 11/2004 | Riebling et al. | 42/70.07 |

* cited by examiner

*Primary Examiner*—Bret Hayes
(74) *Attorney, Agent, or Firm*—Brown & Michaels, PC

(57) ABSTRACT

A firearm trigger locking device with two sides and fixed hardened steel pins. The device is designed to be universal for a particular family of guns—e.g., all rifles, all shotguns, or all handguns (or all revolvers or automatic pistols)—of a given firearm manufacturer. The device further features a pin behind the trigger to prevent firing, hardened steel plates in each side sufficient in size to cover the trigger guard and prevent transverse application of a saw to the trigger guard, and a ring of hardened steel pins around the periphery of the trigger guard to prevent application of a saw between the plates. The method for producing this trigger locking device uses lateral and axial profiles of the family of firearms to develop features and feature locations that will allow it to be used with any member of the family of firearms.

16 Claims, 5 Drawing Sheets

UNIVERSAL FIXED PIN TRIGGER BLOCK

REFERENCE TO RELATED APPLICATIONS

This application claims an invention which was disclosed in Provisional Application No. 60/635,128, filed Dec. 10, 2004, entitled "Universal Fixed Pin Trigger Lock". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of trigger locks for firearms. More particularly, the invention pertains to a trigger lock with fixed pins designed to fit a family of firearms.

2. Description of Related Art

Gun manufacturers generally provide some type of trigger lock or gunlock with new firearms. Numerous locks have been developed for this purpose. Cable locks use lengths of cable extending/threaded through the action of the weapon, blocking usage. Another type of lock is the trigger guard plate lock. The trigger guard plate lock uses two "plate" sections that can be locked together from opposite sides over the trigger guard. A grooved (ratchet) cylinder on this type of lock extends from one section through the trigger guard and locks into the other section. In addition, pins can be provided that extend from one plate and fit into insertion holes in the other plate. When stationary pins (i.e., rigid and non-retractable pins) are used, they are located in such a manner as to abut parts of the trigger guard and/or to otherwise hold the plates in position on a particular fire arm. There are also retractable pin designs having retractable spring biased pins. In this type of design, some pins may be blocked by features of the firearm (such as the trigger guard and trigger), but others will fit in and around these obstructions so as to enter insertion holes in the opposite plate. There are also combinations of cable locks and plate locks.

Thus, there are patents and designs for trigger guard plate locks having multiple stationary pins for particular and individual firearms and there are patents and designs for trigger guard plate locks with retractable pins that will fit many different firearms. However, there are currently no trigger guard plate locks designed with multiple stationary pins for use with a whole family of firearms produced by a particular manufacturer.

SUMMARY OF THE INVENTION

The instant invention deals with a firearm locking device that is designed to be universal for a particular family of guns (e.g., all rifles, all shotguns, or all handguns) of a given firearm manufacturer, with a pin behind the triggers to prevent firing, and steel plates and other features located and sized to cover/surround the trigger guards and prevent saw insertion or other intrusive contact. Further, even though it is not unusual to have pins that run from one plate and fit into holes in the other plate, these pins have previously been laid out so as to fit the trigger/trigger guard/gun profile of only a single weapon. As part of the method of our invention, we take the profiles of all of the rifles, all of the shotguns, and/or all of the handguns of a single manufacturer and work out a pin layout that will fit, ideally, any rifle, any shotgun, and/or any handgun from that manufacturer (i.e. that is "universal" as to a particular family of firearms produced by that manufacturer). We also place a pin behind the trigger to further guard against firing. In addition, the hardened steel plates of our invention extend above, below, and beyond the trigger guard so as to prevent a saw from being transversely brought to bear on the trigger guard. (Sawing away the trigger guard is one of the most common ways of disabling and/or removing a trigger guard plate lock). Finally, we incorporate other features to prevent invasive or destructive contact with the triggers or trigger guards. And, all of these goals are accomplished while meeting or exceeding all requirements set forth in applicable standards for locks of this type (such as those set forth in California Department of Justice AB106 and ASTM F2369-04).

As will be appreciated, it is necessary or beneficial for gun manufacturers and others to provide locks with all firearms sold. And, it is extremely advantageous for them to be able to purchase and stock a lock that will fit a whole family or type of firearm for a manufacturer as opposed to having to buy and maintain an inventory of individualized locks for each firearm sold. The logistics and difficulty of maintaining (and neither over buying nor under buying) locks that can be used for only a single firearm can lead to costly waste and a great deal of inconvenience. Thus, our invention seeks to overcome these problems with a lock that has multiple applications for a single manufacturer, is sturdy, durable, cost efficient, meets all applicable standards, and—with the other innovations set forth herein—admirably and efficiently serves the purposes for which it is designed.

DETAILED DESCRIPTION OF THE INVENTION

Figure 1:
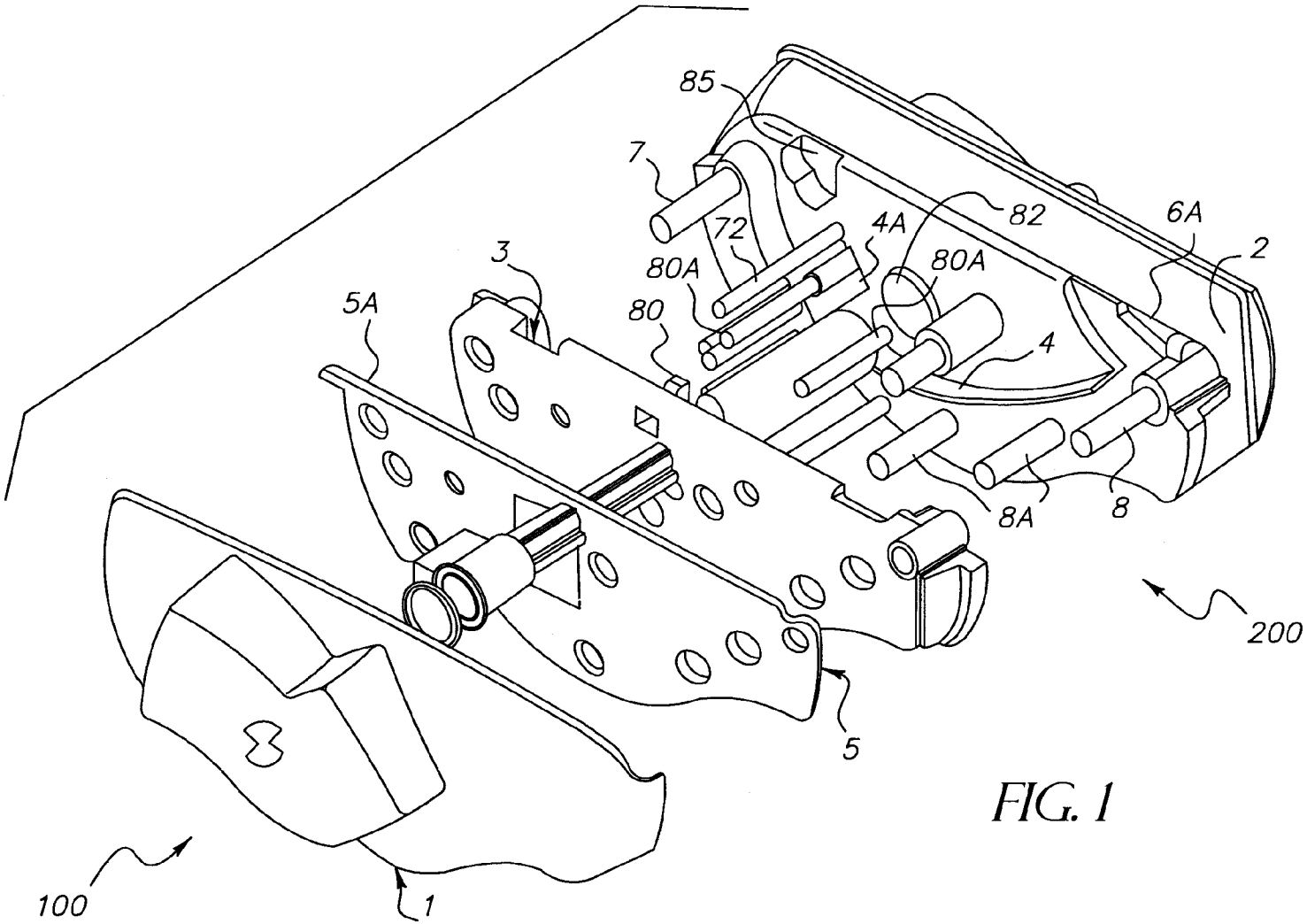
FIG. 1 provides an exploded perspective view of a first preferred embodiment of our invention, showing the right and left sides our invention and their component parts.
Figure 2:
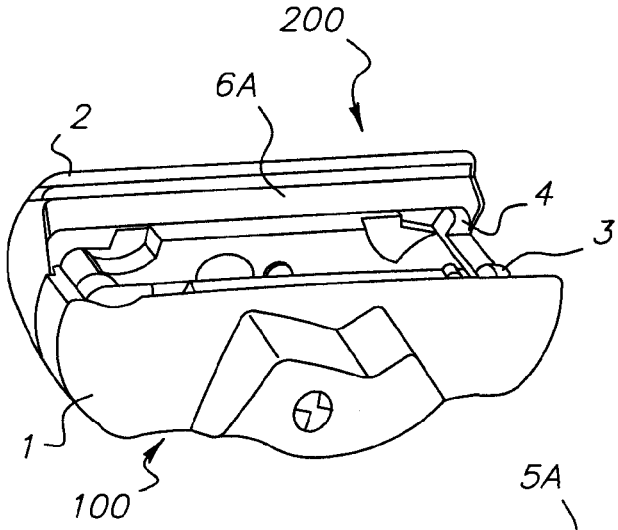
FIG. 2 provides a perspective view from the upper right of the top and right side of the first preferred embodiment of our invention, with the two sides of our invention locked together.
Figure 3:
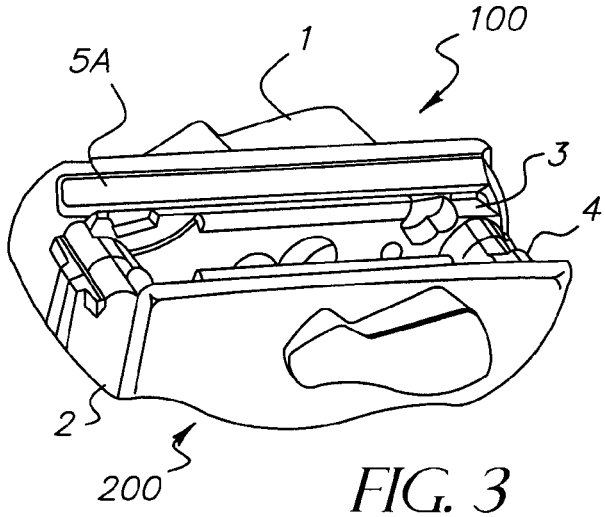
FIG. 3 provides a perspective view from the upper left of the top and left side of the first preferred embodiment of our invention, with the two sides of our invention locked together.
Figure 4:
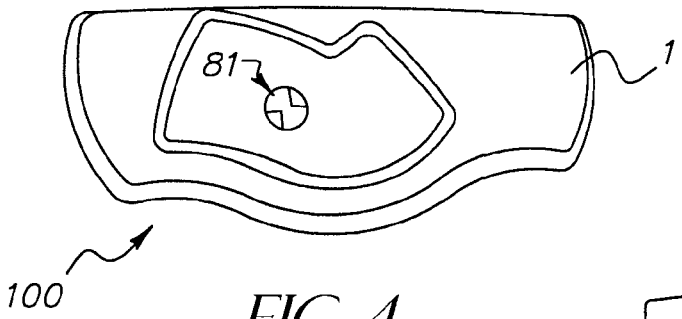
FIG. 4 provides a view from the right side of the first preferred embodiment of our invention with its two sides locked together.
Figure 5:
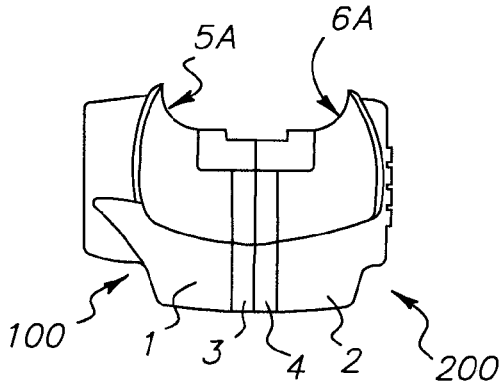
FIG. 5 provides a view from the front of the first preferred embodiment of our invention with its two sides locked together.
Figure 6:
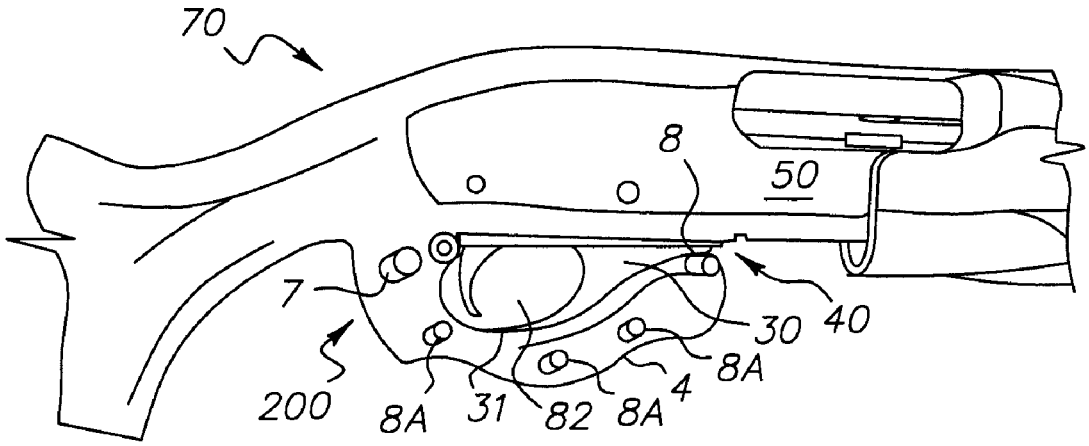
FIG. 6 provides a right side view of the left side of a preferred embodiment of our invention installed over and around the trigger guard of a shotgun.

As will be noted from review of FIGS. 1 through 9, the first preferred embodiment of our invention is comprised of two halves (a right side 100 and a left side 200) that are adapted to fit together over a trigger guard 30 and adjacent the ventral side 40 and lower lateral sides 50, 60 of a firearm (such as illustrated shot gun 70) adjacent the trigger guard 30 of said firearm. The right side 100 includes a zinc die cast right outer housing 1 and the left side, similarly includes a left outer housing 2. Interior of these two housings 1, 2 there are respective polymer interfaces (right interface 3 and left interface 4) formed from, preferably, a sturdy polymer such as 90 Dura Santoprene®.

Right interface 3 and left interface 4 are adapted for non-damaging contact with portions of the trigger guard 30, ventral side 40, and lateral sides 50, 60 of a firearm such as shot gun 70. Sandwiched between these respective outer and inner portions of sides 1, 2 are, respectively, a right protective plate 5 and a left protective plate 6. These plates 5, 6 are formed from hardened steel to resist sawing or other penetrative efforts and extend beyond the front, back and bottom of trigger guard 30 when properly positioned thereon. In addition, plates 5, 6 are shaped to extend upward beyond the trigger guard adjacent and conforming to the lateral sides of a firearm such as shotgun 70.

As is typical of two sided trigger locks of this type, a ratchet post assembly 80 extends from a side bearing the key slot 81 for the lock (which is right side 1 in the embodiments illustrated). Ratchet post assembly 80 is adapted and designed for insertion into a lock receptacle or lock receiver 82 in the opposite side (left side 2 in the embodiments illustrated). Likewise, in the embodiments illustrated, pins (which are numbered and discussed in more detail below) extend from left side 2 so that they can be inserted into and mate with matched pockets or holes (pin receivers) located in right side 1. Thus, as illustrated in FIGS. 6 through 9, left side 1 is adapted to be installed over and around the trigger guard 30 of a firearm (such as shot gun 70). Right side 2 is, appropriately, adapted and designed to be mated and joined with left side 1 (when it is installed in the aforesaid position) so as to be likewise installed over and around trigger guard 30.

However, in our invention, additional features and/or limitations provide a significant advance over prior art. It is, for example, not unusual to have pins that run from one plate (e.g., side 2) and fit into holes in the other plate (e.g., side 1). But, fixed pins have previously been laid out so as to fit the trigger/trigger guard/gun profile of only a single firearm. Alternatively, biased spring-loaded pins or movable pins that can be set for a particular firearm/configuration are not unusual. Our invention is novel and nonobvious in its use of fixed pin locks that are designed, configured and adapted to fit a plurality of firearms from a particular manufacturer. This is enabled as part of the method of our invention, as described in more detail below.

Figure 7:
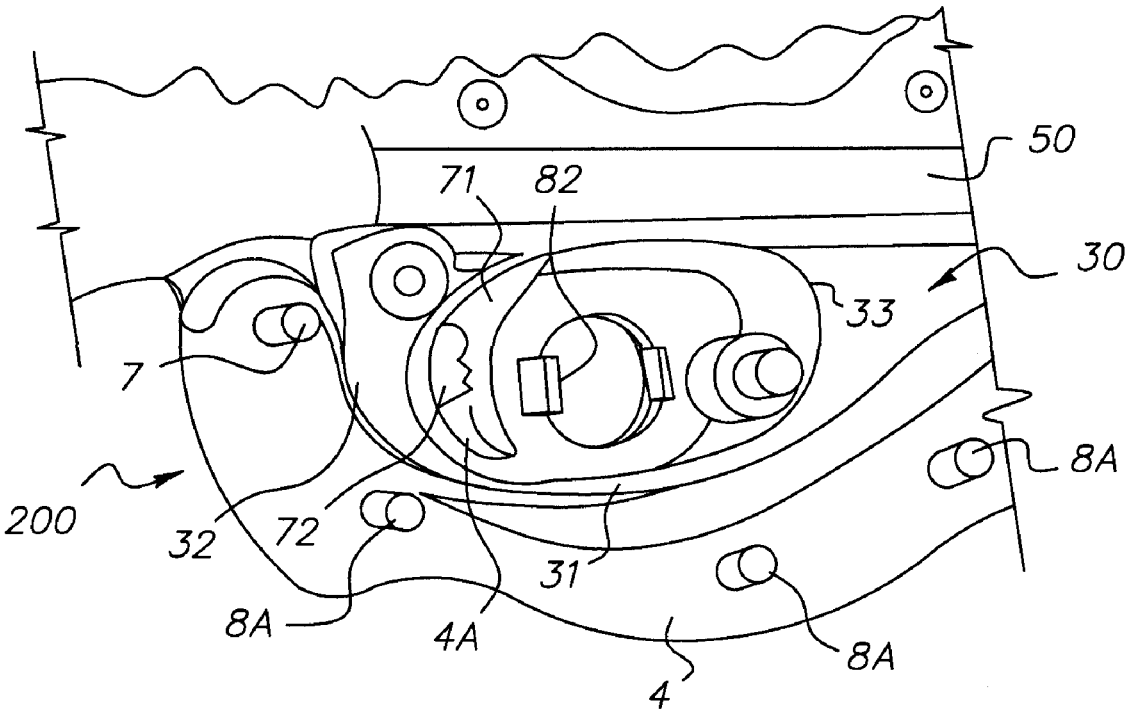
FIG. 7 provides a more detailed right side view the left side of a preferred embodiment of our invention installed over and around the trigger guard of a shot gun.
Figure 8:
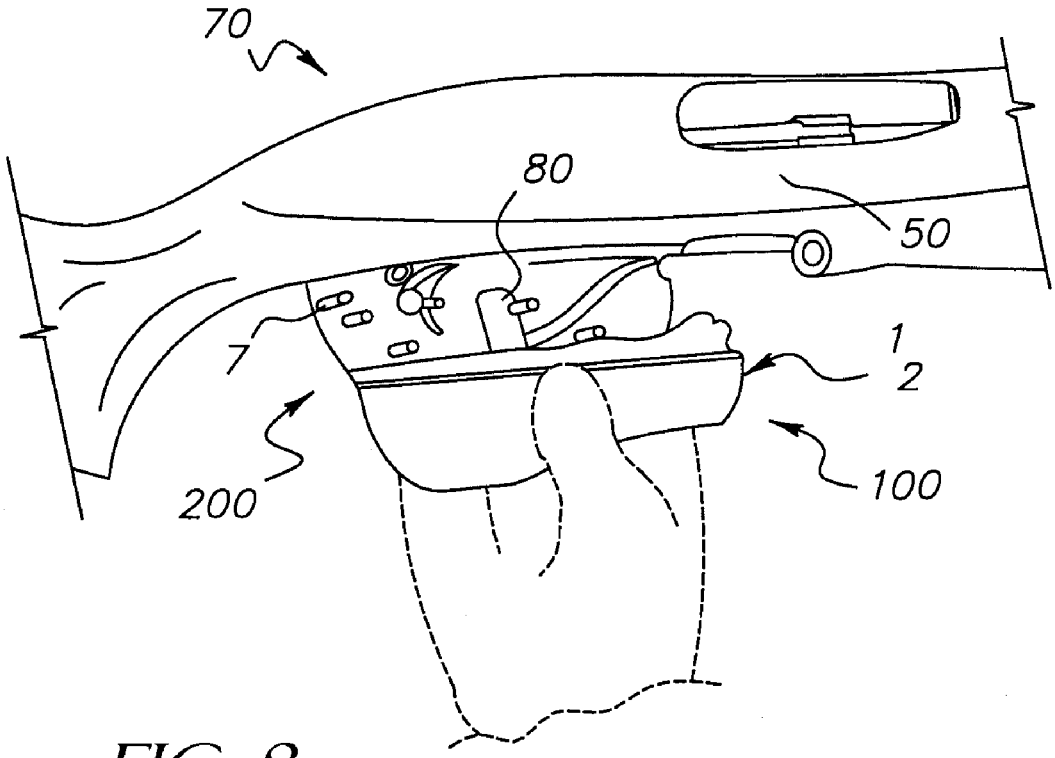
FIG. 8 provides a perspective view of the right side of a preferred embodiment of our invention being joined to the left side of our invention over and around the trigger guard of a shot gun.
Figure 9:
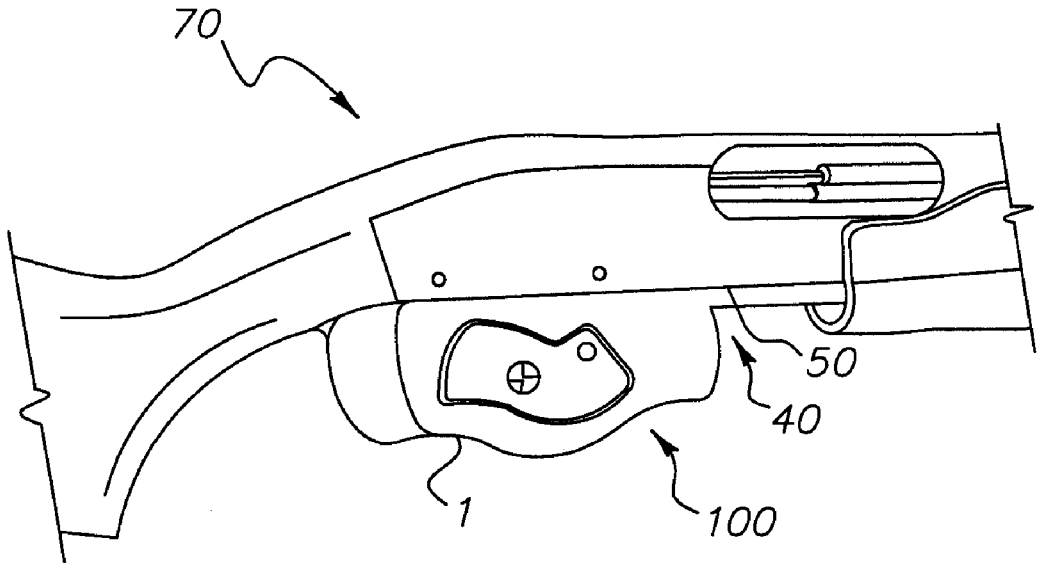
FIG. 9 provides a perspective view of the right side of a preferred embodiment of our invention after being joined to the left side of our invention over and around the trigger guard of a shotgun.

In the method of our invention, we take lateral profiles of regions of a plurality of firearms produced by a single manufacturer (such as, e.g., shotguns like shotgun 70) adjacent and around their trigger guards 30 (i.e., the same general area covered by the trigger lock of this invention as illustrated in FIGS. 7 through 9). These profiles can then be overlaid (manually or preferably by using computer assisted techniques) and otherwise compared so as to determine the placement of features transverse to the trigger guards 30 that will serve to prevent front-to-back and up-and-down movement relative to the trigger guards 30, and/or rotational movement of the lock relative to ratchet post assembly 80 (and/or the trigger guards 30). Likewise, a plurality of cross-sectional profiles of the firearms (i.e., profiles transverse to the barrel/axis of the firearms) are taken in the areas to be covered by the trigger lock of this invention. These can also be overlaid and/or otherwise compared to determine how to snugly fit the sides of the trigger lock against the sides of the firearms and their triggers to eliminate side-to-side (i.e., lateral) movement of the trigger lock.

The aforesaid method, working with the profiles of all of the rifles, all of the shotguns, and/or all of the handguns (or in some cases all of the automatic pistols or revolvers) of a single manufacturer, allows us to work out a pin layout that will fit, ideally, all of said rifles, shotguns and/or handguns (i.e., that is "universal" as to a family of firearms of that manufacturer). And, in some cases, can fit both rifles and shotguns of a particular manufacturer. Our method and apparatus accomplishes this in several ways. First, by elimination of vertical movement (relative to the firearms in leveled/horizontal position). Second, by elimination of anterior/posterior or front-to-back movement (relative to the firearms in leveled/horizontal position). Third, by elimination of lateral or side-to-side movement (relative to the firearms in leveled/horizontal position). Fourth, by achieving snug conformity to the stocks of the firearms. Fifth, by achieving snug conformity to the trigger guards of the firearms. Sixth, by positioning of protective plates 5, 6 and pins 7, 8, 8A so as to defeat any attempt to saw away the trigger guards 30 of the firearms (removing the lock and exposing the trigger 71). Seventh, by positioning portions (upper edges 5A, 6A) of protective plates 5, 6 so as to effectively eliminate any ability to the insert an implement that can reach the triggers 71 or trigger guards 30 of the firearms.

As to the first three dimensional movement factors, blocking members are required. In our invention these are fixed members and are generally comprised of fixed pins or other fixed structural components of the invention. Blocking upward vertical movement requires upper movement blocking members that abut the firearm's ventral side 40 or are placed beneath the trigger guard's underside 31 to prevent upward movement. In the illustrated embodiments, this role is played by a rear upper pin 7, a front upper pin 8 and the upper edges 5A, 6A of, respectively, plate 5 and plate 6. (Upper edges 5A, 6A and upper pins 7, 8 are both sufficient for this purpose—the use of both provides extra redundancy to our design). Blocking downward vertical movement requires downward movement blocking members placed above the trigger guard's underside 31. This role is played by wedge 4A and/or inner member 4B (which includes an inner pin 9) in the embodiments illustrated.

Blocking front-to-back movement requires the placement of additional blocking members. Rearward movement blocking members must be placed behind the rear edge 32 of trigger guard 30, behind the rear edge of trigger 71, and/or behind the front edge 33 of trigger guard 30. These positions are occupied by, respectively, rear upper pin 7 (which does double duty here), wedge 4A (and trigger pin 72), and inner member 4B (with its inner pin 9). And, likewise, forward movement blocking members must be placed in front of the front edge 32 of trigger guard 30 or in front of the rear edge 32 of trigger guard 30. These positions are occupied by, respectively, front upper pin 8 (which also does double duty), wedge 4A, and trigger pin 72.

Side-to-side (or lateral movement) is blocked by the assembly's snug embrace of the trigger guard 30 and the lower lateral sides 50, 60 of the shotgun 70. This also (in conjunction with the fact that plates 5, 6 extend upward beyond the trigger guard 30 adjacent the lower sides 50, 60 of shotgun 70) effectively eliminates any ability to insert an implement from above that could reach trigger guard 30 or trigger 71. In addition, as will be noted, protective plates 5, 6 also extend beyond the trigger guard 30 (anteriorly, posteriorly, and ventrally) so as to prevent a saw from being applied transversely to trigger guard 30. The placement of trigger pin 72 behind trigger 71 provides further assurance that the firearm cannot be discharged.

Hardened steel parts (pins 7, 8 and 8A) around and outside the circumference of trigger guard 30 serve to further secure sides 100 and 200 to each other and provide further security against any attempt to reach trigger guard 30 along the line where the sides 100, 200 meet. These parts can be plates and as such, can be extensions of one or both of the side plates 5, 6. However, pins are the most advantageous as there are manufacturing advantages to their use and, additionally, they can fit into holes in plates 5, 6 (as they do in the preferred embodiments) so that there is no gap whatsoever between the pins 6, 8 and 8A and plates 5, 6 through which a saw could be inserted. Smaller hardened steel pins 80A extend exteriorly of plates 5, 6 to protect the portions of ratchet post assembly 80 extending beyond plates 5, 6 from being attacked by transverse application of a saw. Further, an additional hardened steel disc 82 protects the ratchet post assembly from drilling via the end of ratchet post assembly 80 opposite its key slot 81.

Figure 10:
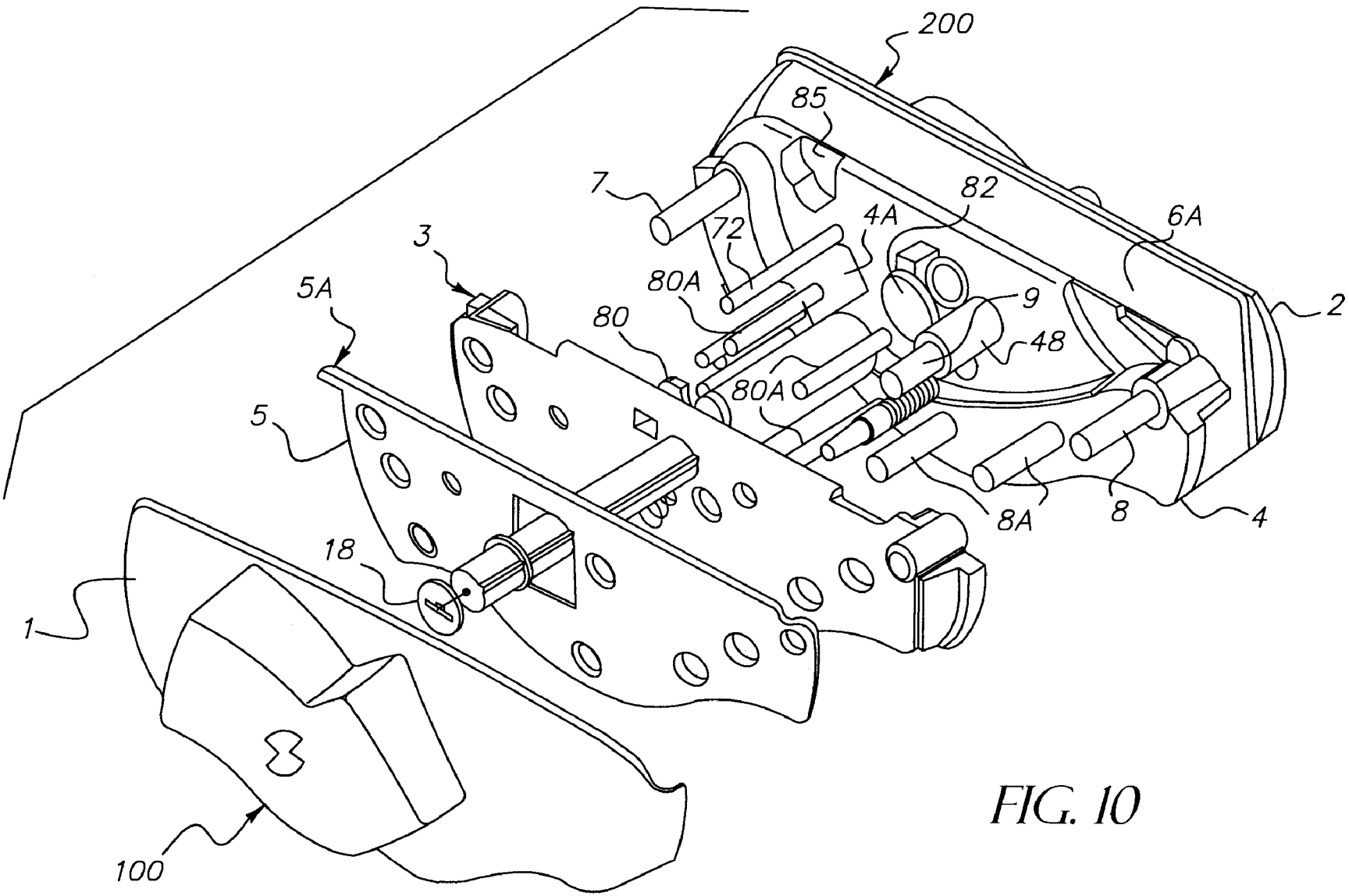
FIG. 10 provides an exploded perspective view of a second preferred embodiment of our invention, showing the right and left side the embodiment and their component parts.

Other features of our invention include the provision of indents 85 in interfaces 3, 4 to allow our invention to accommodate safeties (i.e., safety switches) for the shotguns or rifles in question. Likewise, our invention is provided with sculpted hollows 86 in interfaces 3, 4 to allow it to accommodate (while preferably snugly enclosing) the various trigger guards 30 of the firearms. As with the other features described above, the shape, placement and other particulars of these features are developed based on the method of our invention. Finally, FIG. 10 provides an exploded perspective view of a second preferred embodiment of our invention providing the added security of a freely rotating hardened steel disc intermediate key slot 81 and ratchet post assembly 80. This helps to protect against any attempt to free the lock by drilling into the ratchet post assembly 80 via key slot 81. However, many other variations are possible without exceeding the scope of our invention. Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A firearm lock having a right half and a left half for placement over a right side and a left side of a trigger guard of the firearm, comprising:

a) a right outer housing and a left outer housing each having an outer surface and an inner surface;

b) a right protective plate adjacent to the inner surface of the right outer housing and having a plurality of through holes, c) a left protective plate adjacent to the inner surface of the left outer housing and having a plurality of through holes, each of the through holes being alignable with a corresponding hole through the right protective plate;

d) a right interface member adjacent to the right protective plate and having a plurality of through holes, each of the through holes being alignable with a corresponding hole through the right protective plate;

e) a left interface member adjacent to the left protective plate and having a plurality of through holes, each of the holes being alignable with a corresponding hole through the left protective plate;

f) a plurality of transverse security elements, each security element being retained to either the right outer housing or the left outer housing in a pattern such that when the right and left halves of the lock are assembled the security elements pass through aligned holes in each of the protective plates and the interface members; and g) a transverse locking element, the locking element being activatable to lock together the right half and the left half of the firearm lock;

wherein the right half of the lock comprises: the right outer housing, the right protective plate and the right interface member and the left half of the lock comprises the left outer housing, the left protective plate, and the left interface member, and the two halves, when placed over each side of the trigger guard and locked together, cooperate with elements on the firearm to substantially prevent movement of the trigger lock; and wherein features of the trigger lock are selected such that the same lock will, without modification, fit securely on the trigger guards of a plurality of firearm models produced by a single manufacturer, the selected features comprising at least one of: the pattern and number of the plurality of transverse security elements; a location of the transverse locking element; a contour of the right and left interface members; and a profile of the right and left protective plates.

2. The firearm lock of claim 1, further comprising non-retractable hardened steel parts affixed to the right side or the left side, wherein the hardened steel parts are transverse to the protective plates and the trigger guard and extend between the protective plates and around an exterior of the trigger guard so as to prevent the application of a saw to the trigger guard by insertion of said saw between the protective plates.

3. The firearm lock of claim 2, wherein said hardened steel parts comprise steel pins.

4. The firearm lock of claim 1, wherein each of the protective plates comprises a hardened steel plate.

5. The firearm lock of claim 1, wherein the transverse security elements comprise hardened steel pins.

6. The firearm lock of claim 1, further comprising each interface member having an inner surface contoured for non-damaging contact with at least one surface of the firearm.

7. The firearm lock of claim 6, wherein the surfaces contacted comprise at least one of:

a surface of the trigger guard, and a surface of a side of the firearm.

8. The firearm lock of claim 6, further comprising at least one interface member having the contoured inner surface that includes indents to accommodate a safety of the firearm.

9. The firearm lock of claim 1, wherein each of the protective plates extends beyond a front, a back and a bottom of the trigger guard.

10. The firearm lock of claim 1, wherein each of the protective plates extends beyond a top of the trigger guard and conforms to a lateral side of the firearm.

11. The firearm lock of claim 1, wherein at least one of the plurality of transverse security elements is intermediate the trigger guard and a trigger for the plurality of firearm models.

12. The firearm lock of claim 1 wherein the plurality of firearms produced by the single manufacturer are selected from the group consisting of:

a) all of the current rifle models from the single manufacturer;

b) all of the current shotgun models from the single manufacturer;

c) all of the current revolver models from the single manufacturer;

d) all of the current automatic pistol models from the single manufacturer;

e) all of the current handgun models from the single manufacturer; and f) two or more of (a) through (e).

13. A method for producing a firearm trigger lock that will fit securely on the trigger guards of a plurality of firearm models produced by a single manufacturer, the trigger lock comprising two halves; a plurality of transverse security elements between the halves; and a transverse locking element, comprising:

a) measuring profiles of regions of the plurality of firearm models adjacent to the trigger guard of each firearm model;

b) comparing each of the profile measurements from each of the plurality of firearm models to a corresponding profile measurement from each other firearm model;

c) determining from the comparison a placement of the plurality of transverse security elements such that the trigger lock will, without further modification, fit each of the plurality of firearm models, and such that upon fitting the lock to the trigger guard of each of the plurality of firearm models, the transverse security elements prevent substantial movement of the lock relative to the trigger guards; and d) producing the firearm trigger lock with the placement of transverse security elements determined in step (c).

14. The method of claim 13, wherein the trigger lock further comprises an interface member on an inner surface of at least one half of the lock, the interface member having a contoured surface for non-damaging contact with a surface of the firearm, further comprising the step, after step (b) of:

determining from the comparison, a single surface contour for the interface member that will accommodate the surface of every one of the plurality of firearm models.

15. The method of claim 13, wherein the trigger lock further comprises at least one protective plate, further comprising the step, after step (b) of:

determining from the comparison a single profile for the protective plate such that the at least one protective plate extends beyond the trigger guard of each of the plurality of firearm models so that portions thereof abut the sides of the firearm and prevent the insertion of an implement between said firearm and said at least one protective plate.

16. The method of claim 15, wherein said portions are shaped to conform to the shapes of the plurality of firearm models where they abut each firearm.

* * * * *

UNITED STATES PATENT AND TRADEMARK OFFICE

CERTIFICATE OF CORRECTION

PATENT NO. : 7,367,150 B2
APPLICATION NO. : 11/299217
DATED : May 14, 2008
INVENTOR(S) : Farchione et al.

It is certified that error appears in the above-identified patent and that said Letters Patent is hereby corrected as shown below:

Title page, item [54] and Col. 1, in the TITLE, delete the word "BLOCK" and add the word --LOCK--

Signed and Sealed this

Fifteenth Day of July, 2008

JON W. DUDAS
*Director of the United States Patent and Trademark Office*

UNITED STATES PATENT AND TRADEMARK OFFICE

CERTIFICATE OF CORRECTION

PATENT NO. : 7,367,150 B2
APPLICATION NO. : 11/299217
DATED : May 6, 2008
INVENTOR(S) : Farchione et al.

It is certified that error appears in the above-identified patent and that said Letters Patent is hereby corrected as shown below:

Title page, item [54] and Col. 1, in the TITLE, delete the word "BLOCK" and add the word --LOCK--

This certificate supersedes the Certificate of Correction issued July 15, 2008.

Signed and Sealed this

Fifth Day of August, 2008

JON W. DUDAS
*Director of the United States Patent and Trademark Office*